US010056666B2

(12) United States Patent
Niiranen

(10) Patent No.: US 10,056,666 B2
(45) Date of Patent: Aug. 21, 2018

(54) TUNING ELEMENT FOR RADIO FREQUENCY RESONATOR

(71) Applicant: Tongyu Technology Oy, Espoo (FI)

(72) Inventor: Erkki Niiranen, Ii (FI)

(73) Assignee: Tongyu Technology Oy, Espoo (FI)

( * ) Notice: Subject to any disclaimer, the term of this patent is extended or adjusted under 35 U.S.C. 154(b) by 0 days.

(21) Appl. No.: 15/311,734

(22) PCT Filed: May 22, 2015

(86) PCT No.: PCT/FI2015/050357
§ 371 (c)(1),
(2) Date: Nov. 16, 2016

(87) PCT Pub. No.: WO2015/177412
PCT Pub. Date: Nov. 26, 2015

(65) Prior Publication Data

US 2017/0084977 A1 Mar. 23, 2017

(30) Foreign Application Priority Data

May 23, 2014 (FI) ..... 20145469

(51) Int. Cl.
*H01P 1/203* (2006.01)
*H01P 1/213* (2006.01)
*H01P 5/04* (2006.01)

(52) U.S. Cl.
CPC ..... *H01P 1/2135* (2013.01); *H01P 1/203* (2013.01); *H01P 1/20336* (2013.01); *H01P 5/04* (2013.01)

(58) Field of Classification Search
CPC .. H01P 1/203; H01P 1/20327; H01P 1/20336; H01P 1/20345; H01P 1/2135
(Continued)

(56) References Cited

U.S. PATENT DOCUMENTS 4,488,130 A 12/1984 Young et al.
5,225,799 A 7/1993 West et al.
(Continued)

FOREIGN PATENT DOCUMENTS

CN 101800347 A 8/2010
CN 101964439 A 2/2011
(Continued)

OTHER PUBLICATIONS

International Search Report, Application No. PCT/FI/2015/050357, 6 pages, dated Sep. 8, 2015.
(Continued)

*Primary Examiner* — Rakesh Patel
(74) *Attorney, Agent, or Firm* — FisherBroyles, LLP

(57) ABSTRACT

A filter apparatus includes a first conductive signal line configured to form a first radio frequency resonator; a second conductive signal line configured to form a second radio frequency resonator; a cross-coupling element comprising a first electrode arranged to couple capacitively to the first conductive signal line, a second electrode arranged to couple capacitively to the second conductive signal line, and an electrically conductive signal line coupling the first electrode to the second electrode. The cross-coupling element is bendable with respect to the first conductive signal line and the second conductive signal line to adjust the capacitive coupling.

8 Claims, 4 Drawing Sheets

(58) Field of Classification Search
USPC ..... 333/204, 205, 134
See application file for complete search history.

(56) References Cited

U.S. PATENT DOCUMENTS

| | | | | |
|---|---|---|---|---|
| 5,608,363 | A | 3/1997 | Cameron et al. | |
| 5,677,653 | A * | 10/1997 | Sarkka | H01P 7/10 333/219.1 |
| 6,208,221 | B1 * | 3/2001 | Pelz | H01P 1/20336 333/126 |
| 2012/0092090 | A1 | 4/2012 | Ahn et al. | |

FOREIGN PATENT DOCUMENTS

| | | | |
|---|---|---|---|
| DE | 2218277 | A1 | 10/1973 |
| EP | 0069651 | A1 | 7/1993 |
| EP | 0957527 | A2 | 11/1999 |
| FR | 2509535 | A1 | 1/1983 |
| FR | 2509536 | A1 | 1/1983 |

OTHER PUBLICATIONS

Finnish Search Report, Patent Application No. 20145469, 2 pages, dated Dec. 9, 2014.
Extended European Search Report for corresponding European Application No. 15795450.4, 7 pages, dated Dec. 19, 2017.

* cited by examiner

TUNING ELEMENT FOR RADIO FREQUENCY RESONATOR

CROSS-REFERENCE TO RELATED APPLICATIONS

This application is a National Stage application of International Application No. PCT/FI2015/050357, filed May 22, 2015, which claims benefit to Finnish Application No. FI 20145469, filed May 23, 2014, which are incorporated by reference herein in their entirety.

BACKGROUND

Field

The invention relates to radio frequency resonators

Description of the Related Art

Radio frequency (RF) resonators may be used to realize radio frequency filters such as duplex filters. The RF resonator may comprise a transmission (TX) resonator tuned to a transmission frequency and a reception (RX) resonator tuned to a reception frequency. Tuning of the RF resonator may be needed to adjust the resonance frequency of the resonator to a desired frequency such that the performance of the RF resonator is optimized.

SUMMARY

The invention is defined by the independent claim.

Embodiments are defined in the dependent claims.

BRIEF DESCRIPTION OF THE DRAWINGS

In the following the invention will be described in greater detail by means of preferred embodiments with reference to the accompanying drawings, in which.

DETAILED DESCRIPTION

The following embodiments are exemplary. Although the specification may refer to "an", "one", or "some" embodiment(s) in several locations, this does not necessarily mean that each such reference is to the same embodiment(s), or that the feature only applies to a single embodiment. Single features of different embodiments may also be combined to provide other embodiments. Furthermore, words "comprising" and "including" should be understood as not limiting the described embodiments to consist of only those features that have been mentioned and such embodiments may contain also features/structures that have not been specifically mentioned.

Figure 1:
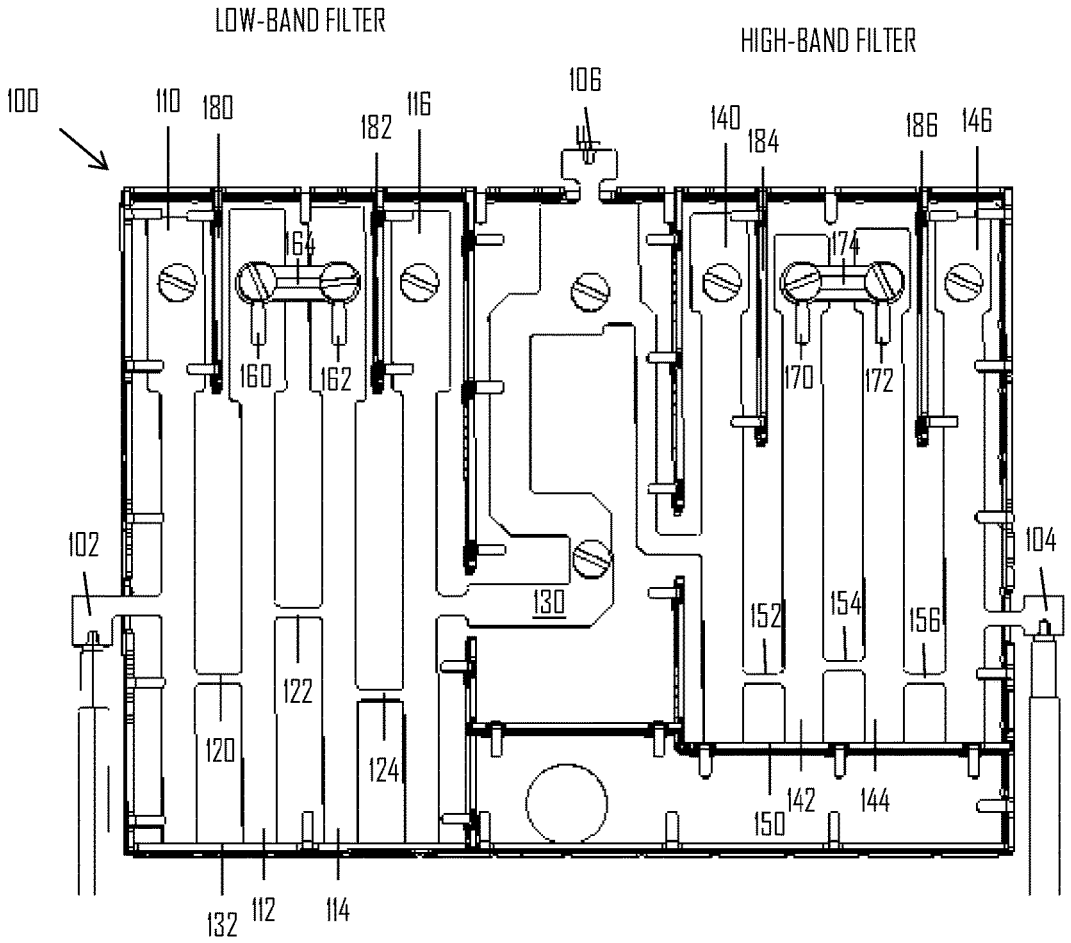
FIG. 1 illustrates a filter structure to which embodiments of the invention may be applied.

FIG. 1 illustrates a resonator structure 100 to which embodiments of the invention may be applied. The resonator structure 100 may be applicable to a high frequency filter, e.g. a radio frequency (RF) filter. The RF filter may be used in a radio transceiver such as a base station of a wireless communication system, e.g. a cellular communication system. Referring to FIG. 1, the resonator structure 100 comprises a plurality of conductive signal lines 110, 112, 114, 116, 140, 142, 144, 146. Each conductive signal line may form a resonator. The length of each resonator may be a quarter of a wavelength of an RF signal with which the resonator is tuned to resonate. In an embodiment, the conductive signal lines form strip-line resonators. FIG. 1 illustrates two filters, each comprising a plurality of resonators. A first filter is formed by the resonators 110 to 116, and a second filter is formed by resonators 140 to 146. The resonators 112 to 116 may be grounded to a common ground 132 at their one end. The other end of each resonator 112 to 116 may be an open end, i.e. ungrounded, to enable the resonators to resonate. The open end may be arranged between a base and a cover of a casing housing the filter such that the open end is not in a mechanical contact with the base and/or the cover. In some embodiments, capacitive coupling between the open end and the cover and/or the base may be realized in order to enable tuning of the resonator. Similarly, the resonators 140 to 146 of the other filter may be grounded to a common ground 150 at one end while the other end is open.

In an embodiment where the resonators are half-wavelength long, both ends of each resonator may be open ends.

The resonators 110 to 116 and/or 140 to 146 may be electrically coupled to each other in order to affect overall frequency properties of each filter. In an embodiment, the resonators of the same filter, e.g. the resonators 110 to 116, may be mechanically coupled to each other with coupling signal lines. In FIG. 1, a coupling signal line 120 connects the resonators 110 and 112 to each other. Similarly, coupling lines 122, 124, 152, 154, 156 connect two resonators together, as illustrated in FIG. 1.

In the embodiment of FIG. 1, the filters are further electrically connected to each other via a transmission line 130. The transmission line 130 may serve as a phasing line enabling adjustment of phasing between the filters. The transmission line 130 may couple the filters to a common signal port 106. Such a three-port filter may be used in a situation where the filters are tuned to different resonance frequencies and their signals are combined to the common signal port 106 further coupled to an antenna. Such a configuration may enable the radio transceiver to operate on multiple transmission/reception frequency bands simultaneously. FIG. 1 illustrates that the filter formed by the resonators 110 to 116 is configured to a lower frequency band while the filter formed by the resonators 140 to 146 is configured to a higher frequency band. The frequency bands may be used for transmission and/or reception, depending on other configurations of the radio transceiver.

A dedicated signal port 102, 104 may be provided for each filter. The signal port may connect the filter to a signal cable such as a coaxial cable connected to other RF components of the radio transceiver, e.g. an RF amplifier, a frequency-mixer, baseband components. Each of the signal ports 102 to 106 may comprise a cable terminal, e.g. a coaxial cable terminal. In another embodiment, a cable is integrated into the signal port 102 to 106. In yet another embodiment, the signal port is a strip line which can be further soldered to a printed circuit board or to a cable, depending on the embodiment.

A function of the coupling lines 120 to 124 and 152 to 156 may be to increase the bandwidth of the filter. In an embodiment where a pass band of the filter is narrow, e.g. a few Megahertz (MHz), the coupling lines 120 to 124 and 152 to 156 may even be omitted. In an embodiment where the pass band is wide, e.g. 100 MHz, the coupling lines 120 to 124 and 152 to 156 may be provided. The bandwidth may further be affected by the selection of the width of the coupling lines 120 to 124 and 152 to 156. A wider coupling line increases the bandwidth.

In an embodiment, walls 180, 182, 184, 186 are provided between at least some of the resonators, e.g. the wall 180 is provided between the resonators 110 and 112. The walls 180 to 186 may be provided at the open ends of the resonators to reduce capacitive coupling between the resonators. The walls 180 to 186 may be made of electrically insulating material.

In an embodiment, the signal lines 102 to 106, 110 to 116, 120 to 124, 130, 140 to 146, and 152 to 156 are all made of a single metal plate cut to the desired form, e.g. the form illustrated in FIG. 1. These signal lines thus form a single integral, mechanical entity. The metal plate may be a copper sheet or a sheet of another material.

Figure 2:
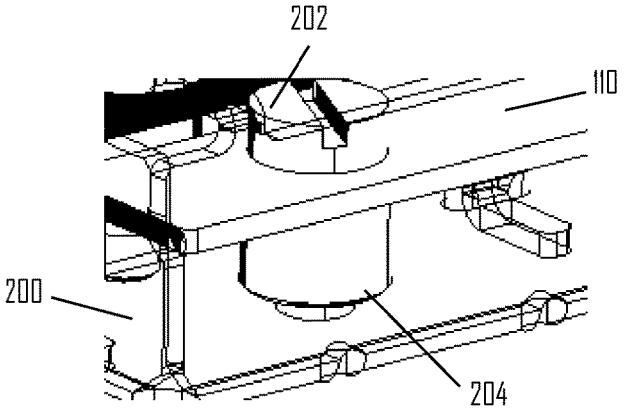
FIG. 2 illustrates a fixing mechanism used in the filter.

FIG. 2 illustrate a fixing mechanism for arranging the resonators to a determined distance from the base 200 and from the cover of a filter casing. Referring to FIG. 2, a resonator 110 is attached to the base 200 at its open end with a fixing mechanism that is electrically non-conductive material, e.g. plastics. The fixing mechanism comprises a support 204 provided between the resonator 110 and the base and acting as both a spacer to define a distance between the base 200 and the resonator 110 and between the resonator 110 and the cover (not shown). The distance may be designed according to desired resonance properties of the resonator 110 by taking into account capacitive coupling between the resonator 110 and the cover and/or the base 200. For example, the resonator may be arranged as inclined such that the distance between the resonator 110 and the cover/base changes between the ends of the resonator 110. This may be arranged with the dimensions of the support and the fixing mechanism at the other end of the resonator 110. The support 204 may comprise a through hole for a screw 202 attaching the resonator 110 to the base through the support 204. The support and/or the base 200 may comprise inner threading matching with outer threading of the screw 202, thus fixing the screw 202 and the resonator 110 to the base 200.

Figure 3:
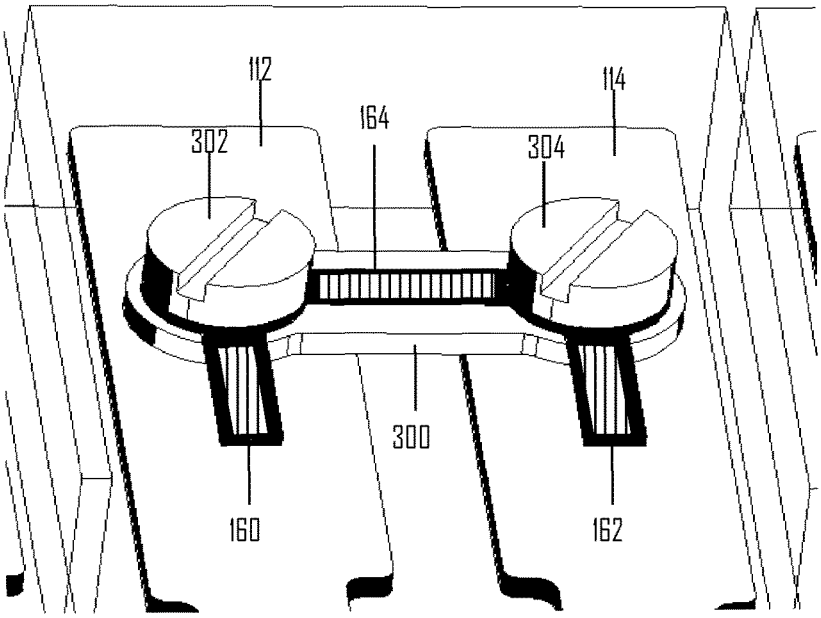
FIG. 3 illustrates a cross-coupling element according to an embodiment of the invention as attached to a resonator.

Referring back to FIG. 1 and FIG. 3, let us consider an embodiment for tuning the filter by providing cross-coupling between at least two resonators of the same filter. Referring to FIGS. 1 and 3, such cross-coupling may be provided by a cross-coupling element comprising a first electrode 160 arranged to couple capacitively to a first conductive signal line 112, a second electrode 162 arranged to couple capacitively to a second conductive signal line 114, and an electrically conductive signal line 164 coupling the first electrode 160 to the second electrode 162. The cross-coupling element may be bendable with respect to the first conductive signal line 112 and the second conductive signal line 114 to adjust said capacitive coupling between the electrodes 160, 162 and the signal lines 112, 114. In order to create the capacitive coupling, the electrodes 160, 162 are galvanically separated from the signal lines such that air or another medium is provided between the electrodes 160, 162 and the respective signal lines 112, 114.

Such a cross-coupling element may be provided for one filter or multiple filters comprised in the same casing. Referring to FIG. 1, the other filter may have a corresponding cross-coupling element comprising the electrodes 170, 172 capacitively coupled to the respective resonators 142, 144 and the signal line 174 bridging the resonators 170, 172 to each other.

In an embodiment, the cross-coupling element is separate from the resonators, i.e. does not belong to the same integral entity as the resonator. The coupling between the cross-coupling element and the resonator may consist of the capacitive coupling.

In an embodiment using the walls 180 to 186 between the resonators at their open ends, the walls may be omitted from the space between open ends of the resonators coupled with each other through the cross-coupling element.

Figure 4:
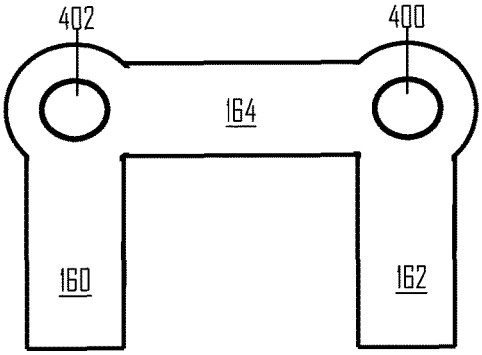
FIG. 4 illustrates the cross-coupling element according to an embodiment of the invention.
Figure 5:
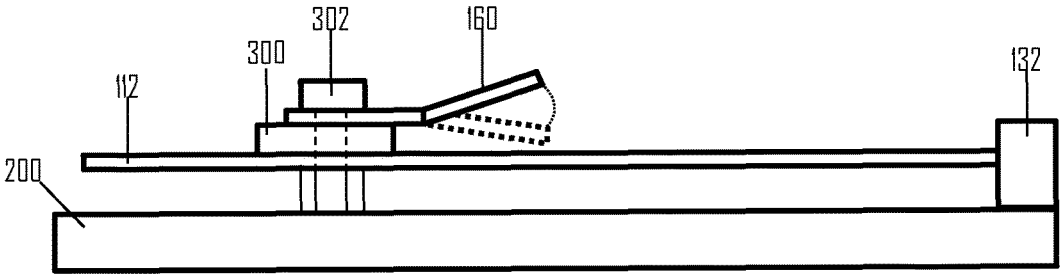
FIG. 5 illustrates adjusting of the cross-coupling element according to an embodiment of the invention.

Let us now consider the cross-coupling element in detail with reference to FIGS. 3 to 5. Referring to FIG. 3, the cross-coupling element may be fixed to the resonators 112, 114 and to the base 200 with screws 302, 304 and supports, as described above with reference to FIG. 2. An electric insulator 300 may be disposed between the resonators 112, 114 and the cross-coupling element such that the insulator 300 is tightened with the screws 302, 304, thus providing the galvanic separation between the resonators 112, 114 and the cross-coupling element. In an embodiment, the insulator is a Teflon (polytetrafluoroethylene) insulator. The insulator 300 may be arranged such that the first electrode 160 and the second electrode 162 remain bendable with respect to the first resonator 112 and the second resonator 114, respectively. In the embodiment of FIG. 3, tabs forming the electrodes 160, 162 extend from a base supported by the insulator 300 and over the edges of the insulator 300 to face the resonators 112, 114 such that air is between the electrodes 160, 162 and the respective resonators 112, 114.

Let us now describe the structure of the cross-coupling element with respect to FIG. 4. In an embodiment, the cross-coupling element is made of a single piece of bendable material, e.g. a metal sheet, cut to the desired form and to comprise the electrodes 160, 162 and the bridge 164. The material of the cross-coupling element may be copper, for example. In the embodiment of FIG. 4, the cross-coupling element is cut to a U-shaped form. In another embodiment, the cross-coupling element may be cut to an S-shaped form.

The cross-coupling element may comprise through holes 400, 402 for the screws 302, 304 that fix the cross-coupling element with respect to the resonators 112, 114 and/or to the base 200.

In an embodiment, the electrodes 160, 162 are provided at ends of the cross-coupling element. In an embodiment, the electrodes 160, 162 are formed by tabs of the cross-coupling element. The bending of the cross-coupling element may change the position of at least one of the tabs 160, 162 with respect to the respective resonator(s) 112, 114.

As FIG. 5, illustrates, the cross-coupling element may be bent to change the distance between the electrode 160 and the resonator 112, thus adjusting the capacitive coupling between the electrode and the resonator and, through the bridge 164 and the other electrode, the coupling between the resonators 112, 114. An aim in adjusting the capacitive coupling may be to affect the frequency response of the filter. One parameter that may be configured with the adjustment of the capacitive coupling between the resonators is the presence and/or location of a zero in the frequency response. Bandwidth may also be affected with the adjustment of the capacitive coupling, e.g. with the tuning of the zero. In an embodiment, increasing the capacitive coupling between the resonators 112, 114 shifts the location of the zero towards lower frequencies in the frequency response. Increasing the capacitive coupling between the resonators 112, 114 shifts the location of the zero towards higher frequencies in the frequency response. In the embodiment illustrated in the Figures, the resonators 112, 114 are strip-lines forming a plane, and the first electrode 160 is arranged to face a plane formed by the first resonator 112 and the second electrode 162 is arranged to face a plane formed by the second resonator 114. In another embodiment applicable to such a design, the capacitive coupling may be adjusted by bending the tabs comprising the electrodes 160, 162 such that a common surface area between the electrodes 160, 162 and the respective resonators 112, 114 changes. For example, the tab may be twisted along its longitudinal axis such that the common surface area changes, thus adjusting the capacitive coupling. Smaller common surface area reduces the capacitive coupling, thus shifting the zero to lower frequencies. In yet another embodiment, the tab may be twisted and bent to change the common surface area and the distance between the electrode and the respective resonator.

In an embodiment, the cross-coupling element comprises insulated wire. In an embodiment, the insulated wire is at least partially coiled. The coil may have a form of a cylinder. In an embodiment, the signal line bridging the electrodes of the cross-coupling element is made of a signal wire coupled to the electrodes or tabs at the locations of the screws or, in general, fixtures that fix the cross-coupling element with respect to the resonators. The cross-coupling element may be provided at the open end of the resonators, as described above. The location of the cross-coupling element may be in the half of the resonator comprising the open end. In yet another embodiment, the cross-coupling element is in a part forming one fourth of the length of the resonator and comprising the open end. The closer to the open end, the higher is the effect of the capacitive coupling through the cross-coupling element. At the grounded end, the coupling between the resonators is mainly inductive because of the common ground 132, 150. However, in some embodiments the cross-coupling element according to any embodiment described herein may be provided at the grounded end of the resonator or in the half of the resonator comprising the grounded end.

As described above, the electrodes may be disposed on top of a below the plane formed by the strip-line resonator. In other embodiments, the electrodes may be disposed such that at least part of the electrodes extends over an edge of the plane and the tab comprising the electrode is bendable in a direction perpendicular to the plane outside the edges of the plane. It may be envisaged that the embodiment of FIG. 3 is modified such that the tabs 162 are provided between the resonators 112, 114 and bendable towards and away from a plane formed by a space between the resonators. In such an embodiment, the electrodes 160, 162 may be provided even in the same tab.

In an embodiment illustrated, the cross-coupling element is bendable to adjust the position of the first electrode and second electrode within a tuning plane formed between a base and a cover of the filter apparatus through the respective conductive signal line. In other embodiments, e.g. the embodiment illustrated in FIG. 5, the tuning plane is limited to the space between the resonator 112 and the cover. In yet another embodiment the tuning plane is limited to the space between the resonator 112 and the base, provided that the tab is disposed between the resonator 112 and the base 200.

The cross-coupling element described herein provides more efficient tuning of the frequency response compared with tuning elements provided in the cover of the filter, because the cross-coupling element may be brought close to the resonators. A tuning element provided in the cover provides for weaker capacitive coupling because of typically higher distance and, additionally, realizing cross-coupling between two resonators is difficult. With the selection of the dimensions of the cross-coupling element, e.g. the tabs, and the selection of the insulator material, a desired tuning range may be achieved to compensate for tolerances in the manufacturing and assembly of the components of the filter.

Figure 6:
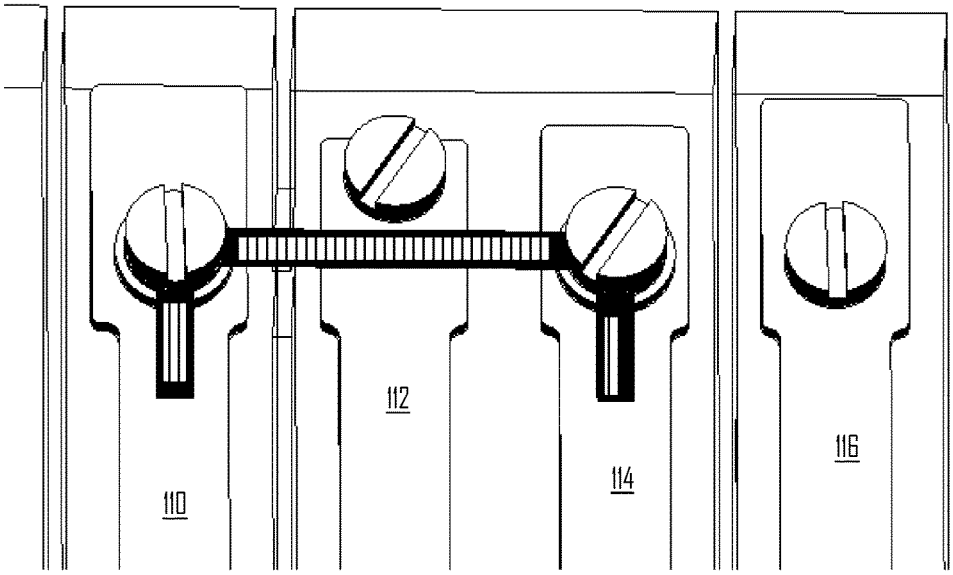
FIG. 6 illustrates another embodiment where the cross-coupling element.

FIGS. 1 to 5 illustrate embodiments where the cross-coupling element couples two adjacent resonators to each other. FIG. 6 illustrates an embodiment where the cross-coupling element couples two resonators not adjacent to each other. The cross-coupling element may extend from one resonator 110 over at least one resonator 112 to a non-adjacent resonator 114. In a similar manner, another embodiment of the cross-coupling element extends over a plurality of resonators, e.g. coupling the resonator 110 to the resonator 116 over the resonators 112, 114. Some capacitive coupling may induce to the resonator 112 over which the cross-coupling element extends but this feature may be used as another tool for adjusting the frequency response of the filter.

In an embodiment, the signal line bridging the electrodes is bent to create a greater distance from the electrodes. For example, in the embodiment of FIG. 6 the bridge may be bent into a U-shaped or V-shaped form to create a greater distance from the electrode 112 over which the bridge travels. In general, the distance between the bridge and the resonator 112 may be greater than a distance between the resonator 112 and a plane formed between the ends of the bridge. Such a bent bridge may be formed from a metal strip or a wire (insulated or not). The greater distance may reduce capacitive coupling between the cross-coupling element and the resonator 112. The bridge may be bent to tune the location of the zero(s) in the frequency response of the filter.

Figure 7:
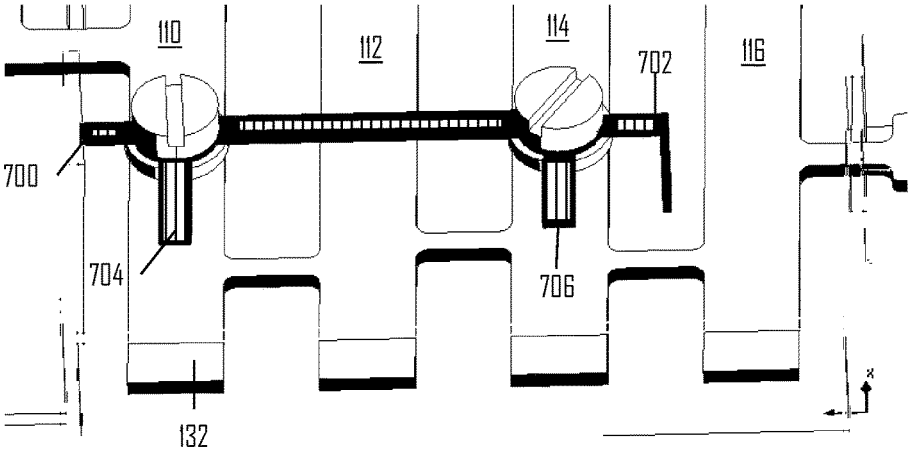
FIG. 7 illustrates an embodiment of a grounded cross-coupling element.

FIG. 7 illustrates another embodiment of the cross-coupling element. In the embodiment of FIG. 7, the cross-coupling element is provided at the grounded end of the resonators 110 to 116. In this embodiment, the cross-coupling element may comprise the tuning tabs 704, 706 on top of the plane of the resonators 110, 114 and a tuning tab 702 outside the plane of the resonators. The cross-coupling element may be grounded at least from one location. Referring to FIG. 7, the cross-coupling element may comprise at least one tab 700, 702 or another part which is coupled to the ground, e.g. the base or the cover of the filter structure. The tab may be arranged to be bendable to fine-tune the capacitive coupling with the ground and/or with the resonators in the similar manner as described above, e.g. the tab 702.

Figure 8:
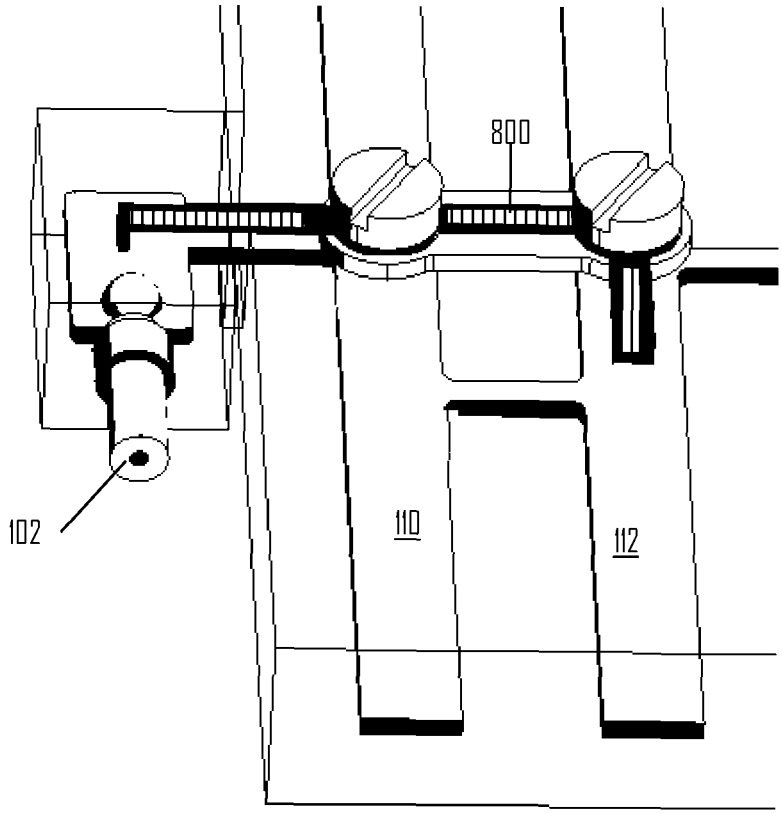
FIG. 8 illustrates yet another embodiment of the cross-coupling element.

FIG. 8 illustrates an embodiment where the cross-coupling element 800 couples a signal port 102 to one of the resonators 112, e.g. over at least one other resonator 110. In another embodiment, the cross-coupling element couples the signal port 102 to a plurality of resonators. The cross-coupling element 800 may comprise a bendable tuning tab capacitively coupling to the signal port 102 and at least one other bendable tuning tab capacitively coupling to the one or more resonators 112. As a consequence, the one or more resonators will be coupled capacitively with the signal port 102. An end of the cross-coupling element farthest away from the signal port 102 may be open-ended or grounded in some embodiments. In an embodiment, an insulator may be provided under the cross-coupling element 800, thus galvanically disconnecting the cross-coupling element from the resonators 110, 112 and realizing only the capacitive coupling. In an embodiment, the insulator may be provided only partially under the cross-coupling element, e.g. the insulator may be replaced by an air gap between the cross-coupling element and at least one resonator over which the cross-coupling element 800 extends, e.g. the resonator 110. Accordingly, capacitive coupling between the cross-coupling element and such a resonator may be increased without using the tuning tabs.

In an embodiment of FIG. 8 where the cross-coupling element comprises the insulated wire mentioned above, the wire may be coupled or soldered to the signal port 102 and, in some embodiments to the ground from the other end.

It will be obvious to a person skilled in the art that, as the technology advances, the inventive concept can be implemented in various ways. The invention and its embodiments are not limited to the examples described above but may vary within the scope of the claims.

What is claimed is:

1. A filter apparatus comprising:

a first conductive signal line configured to form a first radio frequency resonator;

a second conductive signal line configured to form a second radio frequency resonator;

a cross-coupling element comprising a first electrode arranged to be coupled capacitively to the first conductive signal line, a second electrode arranged to be coupled capacitively to the second conductive signal line, and an electrically conductive signal line coupling the first electrode to the second electrode, wherein the cross-coupling element is bendable with respect to the first conductive signal line and the second conductive signal line to adjust said capacitive coupling, wherein the cross-coupling element is fixed to the first conductive signal line and the second conductive signal line such that the first electrode and the second electrode remain bendable with respect to the first conductive signal line and the second conductive signal line, respectively.

2. The filter apparatus of claim 1, wherein the first electrode is provided at a first end of the cross-coupling element and the second electrode is provided at a second end of the cross-coupling element.

3. The filter apparatus of claim 1, wherein the cross-coupling element is made of a single piece of electrically conductive, bendable material.

4. The filter apparatus of claim 3, wherein the cross-coupling element is a metal strip.

5. The filter apparatus of claim 1, wherein the first radio frequency resonator and the second radio frequency resonator are non-adjacent resonators, and wherein the signal line of the cross-coupling element extends over at least one resonator between the first radio frequency resonator and the second radio frequency resonator.

6. The filter apparatus of claim 1, wherein the first conductive signal line and the second conductive signal line are strip-lines forming respective planes, wherein the first electrode is arranged to face the plane formed by the first conductive signal line and the second electrode is arranged to face the plane formed by the second conductive signal line.

7. The filter apparatus of claim 6, wherein the first electrode and the second electrode are bendable such that a distance between the electrode and the respective signal line is adjusted.

8. The filter apparatus of claim 1, wherein the cross-coupling element is bendable to adjust a position of the first electrode and second electrode within a tuning plane formed between a base and a cover of the filter apparatus through the respective conductive signal line.

* * * * *